US009051831B2

(12) United States Patent
Krekula et al.

(10) Patent No.: US 9,051,831 B2
(45) Date of Patent: Jun. 9, 2015

(54) EXPANDABLE MINE BOLT

(76) Inventors: Hakan Krekula, Kiruna (SE); Leif Eriksson, Kiruna (SE)

( * ) Notice: Subject to any disclaimer, the term of this patent is extended or adjusted under 35 U.S.C. 154(b) by 0 days.

(21) Appl. No.: 14/128,334

(22) PCT Filed: Jun. 21, 2012

(86) PCT No.: PCT/SE2012/050695

§ 371 (c)(1),
(2), (4) Date: Dec. 20, 2013

(87) PCT Pub. No.: WO2013/002711

PCT Pub. Date: Jan. 3, 2013

(65) Prior Publication Data

US 2014/0119839 A1 May 1, 2014

(30) Foreign Application Priority Data

Jun. 30, 2011 (SE) ..... 1150608

(51) Int. Cl.
*E21D 21/00* (2006.01)

(52) U.S. Cl.
CPC ..... *E21D 21/00* (2013.01); *E21D 21/0033* (2013.01); *E21D 21/0026* (2013.01); *E21D 2021/0073* (2013.01)

(58) Field of Classification Search
CPC ..... E21D 21/0033; E21D 2021/0073
USPC ..... 405/259.1, 259.3
See application file for complete search history.

(56) References Cited

U.S. PATENT DOCUMENTS

| | | | | | |
|---|---|---|---|---|---|
| 3,797,254 | A | * | 3/1974 | Askey et al. | 405/259.3 |
| 4,459,067 | A | * | 7/1984 | Skogberg et al. | 405/259.3 |
| 4,487,528 | A | * | 12/1984 | Skogberg | 405/259.3 |
| 4,511,289 | A | * | 4/1985 | Herron | 405/259.3 |
| 4,954,017 | A | * | 9/1990 | Davis et al. | 405/259.3 |
| 7,794,179 | B2 | | 9/2010 | Nakako et al. | |
| 2008/0110640 | A1 | | 5/2008 | Bernthaler | |

FOREIGN PATENT DOCUMENTS

| | | | |
|---|---|---|---|
| WO | 2005047652 | A1 | 5/2005 |
| WO | 2005047653 | A1 | 5/2005 |

* cited by examiner

*Primary Examiner* — Frederick L Lagman
(74) *Attorney, Agent, or Firm* — Blank Rome LLP

(57) ABSTRACT

The present invention concerns a tubular rock bolt (1) that can be expanded by a pressurised medium, for insertion into a drilled hole (16) and comprising an extended tubular part (2) with a closed cross-section (12) and provided with a longitudinal stamped part (13) that increases in diameter during the expansion of the rock bolt (1) without the periphery of the tubular part (2) being bent, and an end section (17) at one end (15) of the rock bolt (1) and an end piece (19) arranged at the second end (18) of the rock bolt (1) and provided with a connection part (22) for interaction in a manner that can be released with an expansion means (23). The extended tubular part (2) comprises a reinforcement means (3) that extends internally inside the tubular part (2) between the end section (17) and the end piece (19) and that is attached at the end section (17) and the end piece (19). The invention concerns also the manufacture of a rock bolt.

8 Claims, 4 Drawing Sheets

EXPANDABLE MINE BOLT

RELATED APPLICATION

The present application is a National Phase of PCT/SE2012/050695, filed Jun. 21,2012, which claims the benefit of Sweden Patent Application No. 1150608-6, filed Jun. 30, 2011, the entire disclosures of which are incorporated by reference herein.

The present invention concerns a tubular rock bolt that can be expanded with a pressurised medium for insertion into a drilled hole according to the introduction to claim 1. The invention concerns also a method for the manufacture of a rock bolt according to claim 8.

Prior art expandable rock bolts comprise a tube, the interior of which is set under pressure by a pressurised medium, for example a high-pressure fluid, and thus expand. The rock bolt is introduced into a drilled hole. The medium is supplied from a high-pressure pump through a tube to a connection in the end of the rock bolt that protrudes from the drilled hole. The medium is supplied to the interior of the tube, whereby the tube expands to come into contact with the wall of the drilled hole.

Rock bolts in drilled holes in rock are exposed to an aggressive environment, and also to tensile forces, shear forces and corrosion. This environment influences the lifetime and strength of the rock bolt. The bolt is weakened with time through corrosion, and it may finally fail if it is subject to shear forces and tensile forces. It should be realised that certain bolts are so located in the rock that the forces to which they are subject are relatively small, and that these bolts for this reason do not fail, even if the environment is aggressive.

In order to resist corrosion, the rock bolt may be provided with a coating of an agent that protects from corrosion. This coating may, however, be damaged when the bolt is introduced into the drilled hole. Furthermore, the coating may be damaged when the bolt is expanded, since the shape of the surface of the bolt is changed. This damage leads to openings in which corrosion may become established.

The purpose of the present invention is to provide a rock bolt that demonstrates better strength against the forces to which it is exposed, and greater resistance to corrosion.

This purpose is achieved through a rock bolt that demonstrates an internal reinforcement means that is present in a protected environment as long as the rock bolt is undamaged and that increases the strength of the rock bolt against tensile forces and shear forces.

Figures 1, 2:
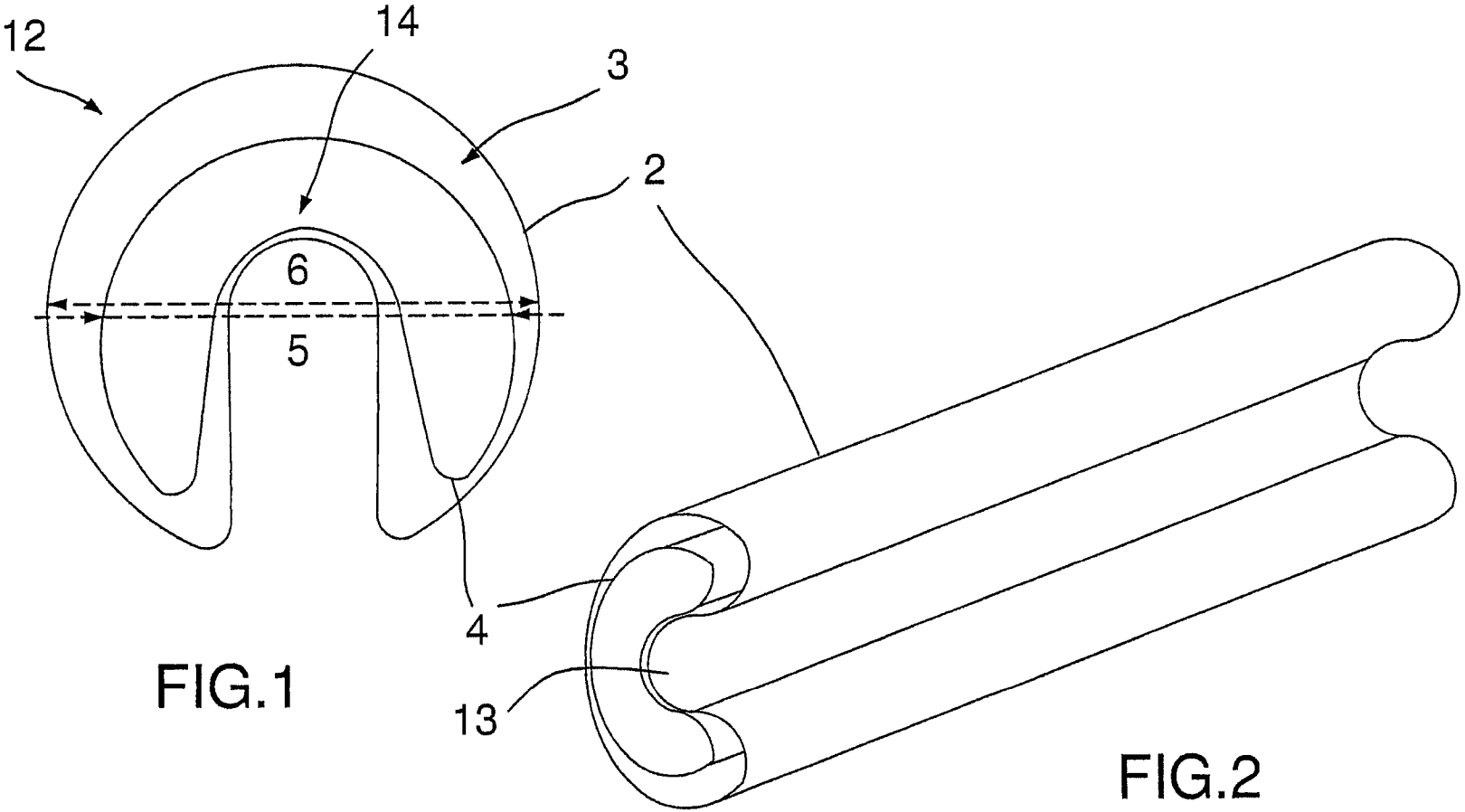
Figures 9, 10:
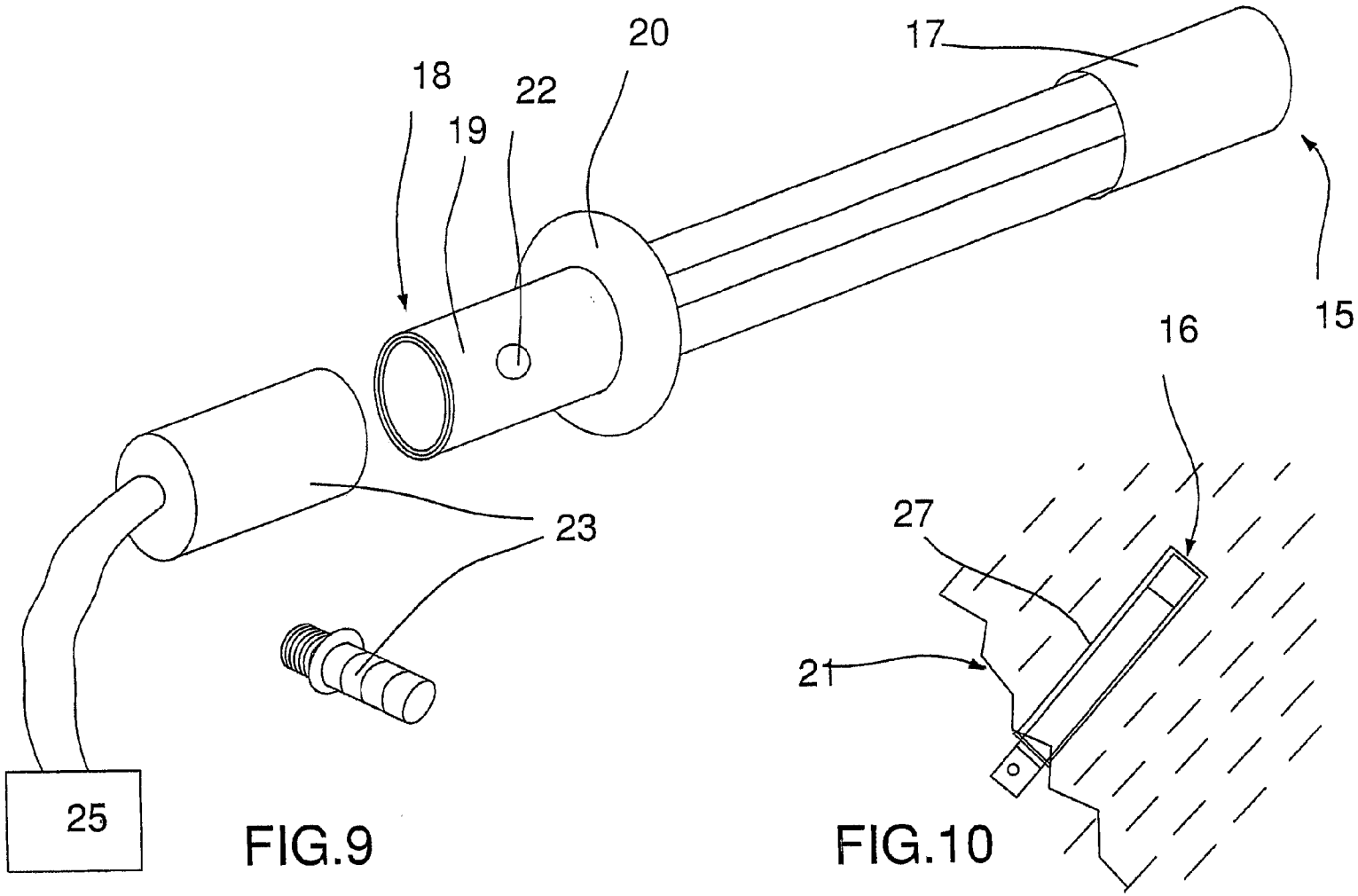
Figure 12:
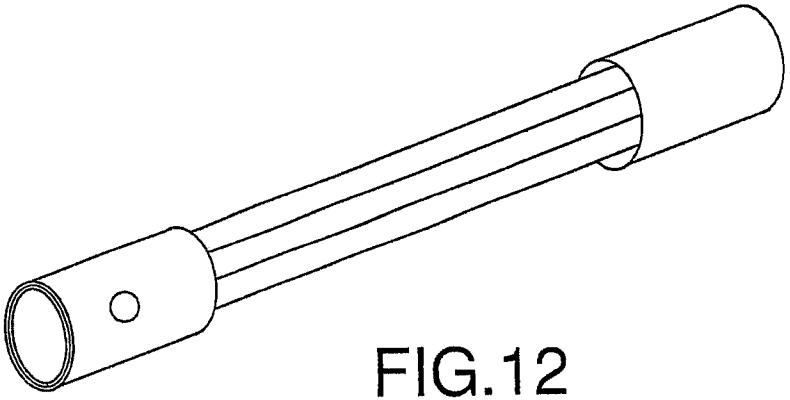
Figure 13:
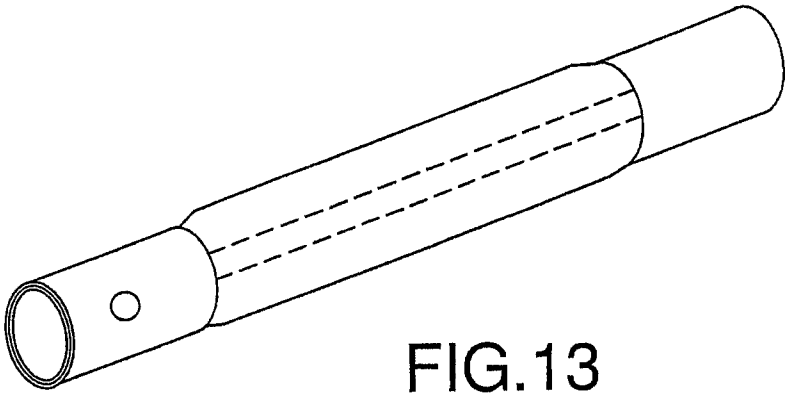
Figure 11:
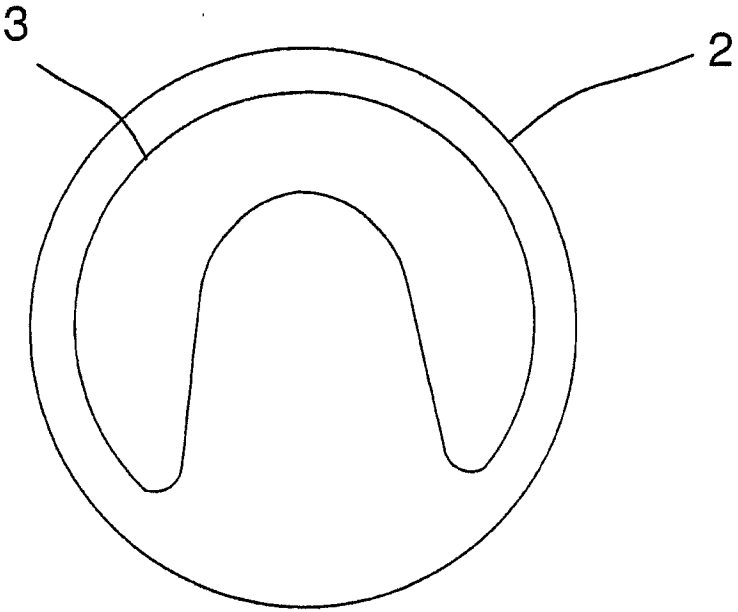

The invention will be described below with reference to the attached drawings, in which:

FIG. 1 shows a cross-section of a rock bolt according to the invention,

FIG. 2 shows a perspective view of an external tubular part with a reinforcement means, FIGS. 3-8 show cross-sections of a rock bolt with different types of reinforcement means, FIG. 9 shows an assembled rock bolt, FIG. 10 shows schematically a section of a rock wall with a drilled hole into which a rock bolt has been mounted, FIG. 11 shows a cross-section of a rock bolt after it has been expanded, and FIGS. 12 and 13 show perspective views of a rock bolt before and after it has been expanded.

Figure 3:
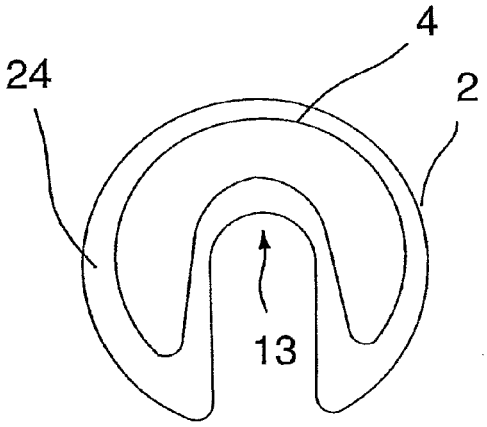
Figure 4:
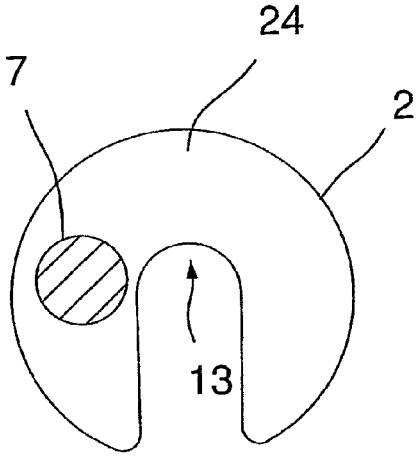
Figure 5:
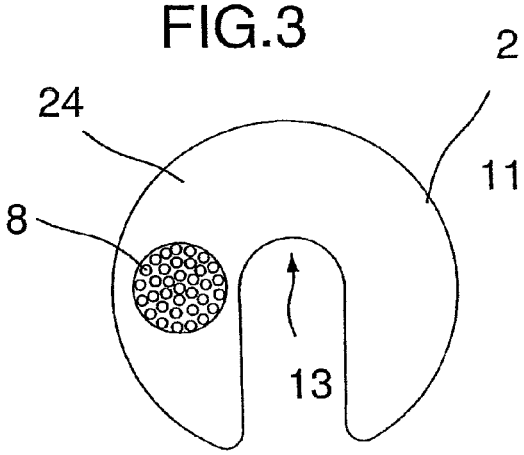
Figure 6:
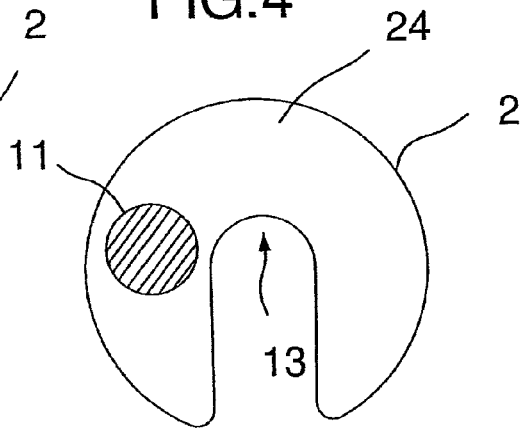
Figure 7:
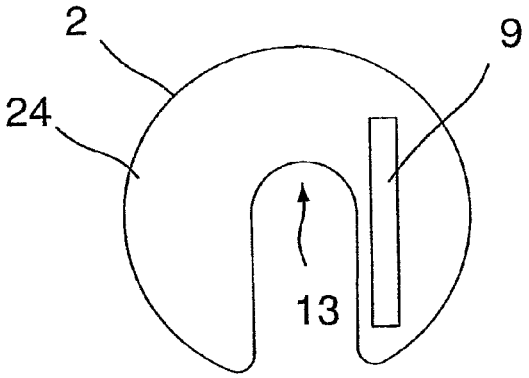
Figure 8:
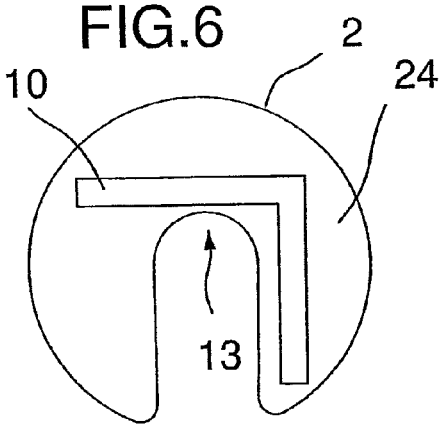

FIG. 1 shows a cross-section of a rock bolt 1 according to the invention. It comprises an extended external tubular part 2 and an internal reinforcement means 3. In this embodiment, the internal reinforcement means 3 comprises a second tubular part 4, with an external diameter 5 that is less than the internal diameter 6 of the outer tubular part. In a second embodiment that is shown in FIGS. 3-5, the reinforcement means 3 comprises a reinforcement member, a steel or iron rod 7, or a wire 8. In a further embodiment, the reinforcement means comprises an extended flat metal piece 9 or angled metal piece 10 according to FIGS. 7-8. In a further embodiment, the reinforcement means comprises an extended member 11 of a composite material, as can be seen in FIG. 6.

The external tubular part 2 demonstrates, according to FIGS. 1 and 2, a closed cross-section 12, and it is arranged with a longitudinal fold 13 that extends along the complete length of the external tubular part 2. The purpose of this fold 13 is to give the tubular part 2 the possibility of expanding without bending its surface. When the internal reinforcement means 3 comprises a tube, this internal tube is arranged with a longitudinal fold 14 during the manufacture of the rock bolt 1.

One end 15 of the external tubular part 2, the end that is intended to be placed farthest into a drilled hole 16 when the rock bolt 1 has been placed into the drilled hole 16, comprises an end section 17 in the form of a sheath, which can be seen in FIGS. 9 and 10. The sheath is welded or attached by another method to the reinforcement means 3 and to the end 15 of the external tubular part 2, thus sealing the end. The second end 18 of the tube, the end that is located outside of the drilled hole 16 when the rock bolt 1 is mounted into the drilled hole 16, is provided with an end piece 19 in the form of a sheath that is welded or attached by another method to the second end of the reinforcement means 3 and the external tubular part 2, and seals this end. Before the rock bolt 1 is mounted in the drilled hole 16, a washer 20 is arranged on the external tubular part. The washer 20 is arranged to be in contact with the end piece 19 at the end 18 of the rock bolt 1, and is intended to be in contact with the rock wall 21 when the rock bolt 1 has been arranged in the drilled hole 16.

The end piece 19 is arranged with a connection part 22 for an expansion means 23. The connection part 22 comprises a hole or an opening for communication with the interior compartment 24 that is formed by the external tubular part 2. The expansion means 23 comprises a connector, for example a sheath provided with a gasket that is threaded on outside of the end piece or a nipple, and it is connected to a source 25 of high-pressure fluid, such as water. It should be realised that another type of fluid can be used, for example pressurised air.

A rock bed 26 is shown in FIG. 10 with a drilled hole 16 in the rock bed. It is appropriate that the drilled hole 16 extend to a depth that exceeds the extension in the same direction of the rock material that is to be reinforced. A rock bolt 1 is placed in the drilled hole 16, which rock bolt has been expanded to make contact with the walls 27 of the drilled hole 16.

Cross-sections of a rock bolt 1 arranged in a drilled hole 16 are shown in FIGS. 3-8. The drawings show the rock bolt 1 before it has been expanded. The reference number 13 refers to the stamped fold in the external tubular part 2, and the reference number 14 refers to the stamped fold in the reinforcement means 3 when this comprises a tubular reinforcement means. FIG. 11 shows a cross-section of the rock bolt 1 from FIG. 1 after it has been expanded through the supply of a pressurised medium. As can be seen, only the external tube 2 expands, while the reinforcement means 3, when this comprises a tube, is not affected by the pressurised medium. In this way the internal tube 3 is not subject to what is known as deformation hardening, and the reinforcement means 3 is in a protected environment inside the external tubular part 2 as long as the rock bolt 1 is undamaged. FIG. 12 shows a perspective view of a rock bolt according to the invention before it has been expanded, and FIG. 13 shows a perspective view of the same rock bolt after it has been expanded.

The rock bolt 1 can fail if it is exposed to tensile forces and shear forces from the motion of the rock, if these forces become too great. It can also become weaker with time through corrosion due to the cracks that form in the surface of the external tubular part 2 when the rock bolt 1 is expanded, which leads to the possible failure of the rock bolt 1. When it fails, the reinforcement means 3 absorbs the forces that the external tubular part 2 of the rock bolt is intended to absorb. Due to the reinforcement means 3 having been kept in a protected environment, and due to it not having been expanded, the reinforcement means 3 is in its original condition, and is thus able to withstand corrosion attack better than the external tubular part 2 of the rock bolt, and the lifetime of the rock bolt 1 is in this way extended.

When the rock bolt 1 is subject to tensile forces, when the rock is influenced by seismic motion and cracks, the rock bolt bends and may finally fail. Due to both the external tubular part 2 and the reinforcement means 3 being attached at the end section 17 and the end piece 19, the tensile force is displaced from the external tubular part 2 to the reinforcement means 3 when the external tubular part 2 fails.

When the rock bolt 1 has been arranged in the drilled hole 16 and has been expanded to come into contact with the walls 27 of the drilled hole, the external tubular part 2 can only be bent through a limited amount at the parts that can slide against the walls of the drilled hole and at the end that protrudes from the drilled hole. When the external tubular part 2 has been exposed to forces that exceed its strength, the internal reinforcement means 3 continues to absorb forces, since it is freely attached between the end section 17 and the end piece 19, and can be bent along its complete length between the end section and the end piece. Thus, it should be realised that the proposed rock bolt absorbs energy and can absorb the dynamic loads to which the rock bolt is exposed during motion of the rock. The shear strength and tensile strength of the rock bolt increase also due to the amount of steel per cross-sectional area being increased above that of rock bolts according to the prior art technology.

A rock bolt 1 according to the invention is manufactured through:

- that the length and the diameter of the hole (16) in the rock are determined,
- that an extended tubular part 2 is arranged,
- that an extended reinforcement means 3 is arranged,
- that the reinforcement means 3 is inserted into the tubular part 2,
- that the unit 28 that has been thus formed from the two parts 2, 3 that have been placed together, one inside the other, is placed into a forming arrangement (not shown in the drawings),
- that one side 15 of the unit 28 is attached to an end section 17 while the second side 18 of the unit 28 is attached to an end piece 19,
- that a longitudinal fold 13, 14 is formed along the extent of the unit 28,
- that a hole 22 is made in the end piece 19 for the connection of the rock bolt 1 to a pressurised medium.

When the reinforcement means 3 of the rock bolt 1 comprises a tube that is placed inside the external tubular part 2, also the reinforcement means 3 is provided with a fold 14 when the fold 13 is rolled or pressed into the external tubular part 2 of the rock bolt 1. The pressurised medium is led only into the external tubular part 2, for which reason the reinforcement means 3, in the cases in which this comprises a tube, continues to demonstrate the longitudinal fold 14 after the expansion. The advantage of this is that the form of the surface of the reinforcement means 3 is not changed during the expansion, and for this reason is not influenced by the corrosion protection of the reinforcement means 3, which—furthermore—is not deformation hardened.

The present invention is not limited to what has been described above and shown in the drawings: it can be changed and modified in several different ways within the scope of the innovative concept defined by the attached patent claims.

The invention claimed is:

1. A tubular rock bolt (1) that can be expanded by a pressurized medium, for insertion into a drilled hole (16) and comprising an extended tubular part (2) with a closed cross-section (12) and provided with a longitudinal stamped part (13) that increases in diameter during the expansion of the rock bolt (1) without the periphery of the tubular part (2) being bent, and an end section (17) at one end (15) of the rock bolt (1) and an end piece (19) arranged at the second end (18) of the rock bolt (1) and provided with a connection part (22) for interaction in a manner that can be released with an expansion means (23), characterised in that the extended tubular part (2) comprises a reinforcement means (3) that extends internally inside the tubular part (2) between the end section (17) and the end piece (19) and that is attached at the end section (17) and the end piece (19).

2. The tubular rock bolt (1) according to claim 1, whereby the reinforcement means (3) comprises an extended tube (4) with an external diameter (5) that is less than the internal diameter (6) of the tubular part (2).

3. The tubular rock bolt (1) according to claim 1, whereby the reinforcement means (3) comprises a wire.

4. The tubular rock bolt (1) according to claim 1, whereby the reinforcement means (3) comprises a steel rod or iron rod or a reinforcement member.

5. The tubular rock bolt (1) according to claim 1, whereby the reinforcement means (3) is manufactured from composite material.

6. The tubular rock bolt (1) according to claim 2, whereby the reinforcement means (3) is arranged with a longitudinal stamped part (14).

7. The tubular rock bolt (1) according to claim 6, whereby the pressurised medium is in connection with a compartment (24) defined by the tubular part, in which compartment the reinforcement means (3) is arranged.

8. A method for the manufacture of a tubular rock bolt (1), characterised in that the method comprises the following operational steps:

- that a length and a diameter of the hole (16) in a rock are determined,
- that an extended tubular part (2) is arranged,
- that an extended reinforcement means (3) is arranged,
- that the reinforcement means (3) is inserted into the tubular part (2),
- that a unit (28) formed from the extended tubular part (2) and the extended reinforcement means (3) that have been placed together, one inside the other, is placed into a forming arrangement,
- that one side (15) of the unit (28), formed from the extended tubular part (2) and the extended reinforcement means (3) that have been placed together, one inside the other, is attached to an end section (17) while a second side (18) of the unit (28), formed from the extended tubular part (2) and the extended reinforcement means (3) that have been placed together, one inside the other, is attached to an end piece (19),
- that a longitudinal fold (13, 14) is formed along the extent of the unit (28), formed from the extended tubular part (2) and the extended reinforcement means (3) that have been placed together, one inside the other, that a hole (22) is made in the end piece (19) for the connection of the rock bolt (1) to a pressurised medium.

* * * * *